US005552036A

United States Patent [19]

Foret et al.

[11] Patent Number: 5,552,036

[45] Date of Patent: Sep. 3, 1996

[54] PROCESS FOR REDUCING THE LEVEL OF SULFUR IN A REFINERY PROCESS STREAM AND/OR CRUDE OIL

[76] Inventors: Todd L. Foret, 107 N. Morein St., Ville Platte, La. 70586; William D. Mansfield, 11543 Blackwater Rd., Baker, La. 70714; Hubert P. Vidrine, Rte. 1, Box 191, Opelousas, La. 70570

[21] Appl. No.: 251,890

[22] Filed: Jun. 1, 1994

[51] Int. Cl.[6] ..... C10G 29/20

[52] U.S. Cl. ..... 208/236; 208/237; 208/208 R; 210/708; 210/749; 210/757

[58] Field of Search ..... 208/237, 208 R, 208/236; 210/708, 749, 757

[56] References Cited

U.S. PATENT DOCUMENTS

| | | | |
|---|---|---|---|
| 2,336,598 | 12/1943 | Downing | 44/73 |
| 2,446,969 | 8/1948 | Welch | 260/666.5 |
| 2,483,889 | 10/1949 | Morrell | 260/666.5 |
| 2,947,795 | 8/1960 | Keown | 260/678 |
| 3,683,024 | 8/1972 | Kuntshik | 260/566 |
| 3,879,311 | 4/1975 | Schott et al. | 252/415 |
| 4,101,444 | 7/1978 | Burk et al. | 252/411 |
| 4,190,554 | 2/1980 | Yamauchi et al. | 252/412 |
| 4,237,326 | 12/1980 | Fuga | 585/4 |
| 4,269,717 | 5/1981 | Slovinsky | 210/750 |
| 4,350,606 | 9/1982 | Cuisia et al. | 252/392 |
| 4,487,745 | 12/1984 | Weiss et al. | 422/16 |
| 4,497,702 | 2/1985 | Miller | 208/47 |
| 4,551,226 | 11/1985 | Ferm | 208/48 |
| 4,556,476 | 12/1985 | Miller | 208/48 |
| 4,927,519 | 5/1990 | Forester | 208/48 |
| 5,100,532 | 3/1992 | Roling et al. | 208/48 |
| 5,213,678 | 5/1993 | Rondum et al. | 208/48 |
| 5,243,063 | 9/1993 | Devicaris et al. | 558/304 |
| 5,282,957 | 2/1994 | Wright et al. | 208/48 |

FOREIGN PATENT DOCUMENTS

| | | | |
|---|---|---|---|
| 1013041 | 1/1989 | Japan | C07C 7/20 |
| 1566106 | 4/1980 | United Kingdom . | |

OTHER PUBLICATIONS

*Advances in Chemistry Series*, "Effect of Additives in Petroleum–Derived Fuels", pp. 238–239.

Product Brochure entitled "Olefins Process Treatment", 1990, Drew Chemcial Corporation.

Knight et al., Cracking and Reforming, Modern Petroleum Technology, 1973, pp. 327–344.

Drew Product Data Sheet, "MEKOR® CG Corrosion Inhibitor," Mar. 1994.

Drew Product Data Sheet, "MEKOR® 70 Corrosion Inhibitor," Mar. 1994.

Drew Product Data Sheet, "MEKOR® 6701 Corrosion Inhibitor," Mar. 1994.

Drew Product Data Sheet, "DREWCOR® 2130 Corrosion Inhibitor," Mar. 1994.

Drew Product Data Sheet, "DREWCOR® 2170 Corrosion Inhibitor," Mar. 1994.

Drew Product Data Sheet, "Case History DREWKOR® Corrosion Inhibitor," 1990.

Drew Product Data Sheet, "DREWCOR® 2130 Corrosion Inhibitor," 1990.

Drew Product Data Sheet, "MEKOR® 6173 Corrosion Inhibitor," Mar. 1994.

Drew Product Data Sheet, "MEKOR® Corrosion Inhibitor," Mar. 1994.

Drew Product Data Sheet, "MEKOR® Corrosion Inhibitor," General, 1990.

*Primary Examiner*—Helane Myers

*Attorney, Agent, or Firm*—Pollock, Vande Sande & Priddy

[57] ABSTRACT

This invention relates to a process for reducing the sulfur in a refinery process stream and/or crude oil, which comprises treating said refinery process stream and/or crude oil with an effective sulfur reducing amount of a reducing agent selected from the group consisting of hydrazine, oximes, hydroxylamines, carbohydrazide, erythorbic acid, and mixtures thereof wherein the reducing agent or the hydrocarbon treated has a temperature of at least 50° C.

14 Claims, 1 Drawing Sheet

PROCESS FOR REDUCING THE LEVEL OF SULFUR IN A REFINERY PROCESS STREAM AND/OR CRUDE OIL

FIELD OF THE INVENTION

This invention relates to a process for reducing the level of sulfur in a refinery process stream and/or crude oil, which comprises treating said refinery process stream and/or crude oil with an effective sulfur reducing amount of a reducing agent selected from the group consisting of hydrazine, oximes, hydroxylamines, carbohydrazide, erythorbic acid, and mixtures thereof wherein the reducing agent or the hydrocarbon treated has a temperature of at least 50° C.

BACKGROUND OF THE INVENTION

One of the major contaminants found in crude oil and refinery streams is sulfur. The amount of sulfur found in crude oil typically ranges from 0.001 weight percent to 5.0 weight percent based upon the total weight of the crude oil. Typically, the sulfur is in the form of dissolved free sulfur, hydrogen sulfide, and/or organic sulfur compounds such as thiophenes, sulfonic acids, mercaptans, sulfoxides, sulfones, disulfides, cyclic sulfides, alkyl sulfates and alkyl sulfides.

Since the amount of sulfur permitted in gasoline and other fuels refined from crude oil is regulated by state and federal authorities, fuels produced from crude oil typically contain less than 1.0% to less than 0.05% by weight sulfur. The actual sulfur content of the fuel is primarily dependent upon the sulfur content of the crude oil being refined and the degree of additional processing, such as hydrotreating, that is performed on the refined product. Obviously, it is more expensive to reduce the sulfur content of higher sulfur containing crude oil, thus the production cost of fuels, particularly gasoline and diesel, will be higher for fuels produced from higher sulfur content crude oils.

Typically sulfur from crude oil is eliminated during the refinery process by hydrotreating which requires expensive equipment and creates hydrogen sulfide ($H_2S$), a toxic gas that requires additional expense for its safe processing. As a consequence, the price differential between low sulfur and high sulfur crude oil reflects to some extent the capital cost of desulfurization, as well as the increasing demand for lower sulfur fuels.

In view of this background, there obviously is a need for less expensive methods of desulfurizing crude oil and desulfurizing crude oil before it is processed in the refinery. This is particularly true for smaller refineries which cannot afford expensive hydrotreating equipment.

SUMMARY OF THE INVENTION

This invention relates to a process for reducing the level of sulfur in a refinery process stream comprising:

treating said refinery process stream with an effective sulfur reducing amount of a reducing agent selected from the group consisting of hydrazine, oximes, hydroxylamines, carbohydrazide, erythorbic acid, and mixtures thereof wherein the reducing agent, the hydrocarbon treated, or both have a temperature of at least 50° C. to thereby reduce the level of sulfur in said refinery process stream.

The process can also be used to reduce the level of sulfur in crude oil or a process stream which contains crude oil and/or mixtures of other hydrocarbons. With respect to reducing the level of sulfur in crude oil, the reducing agent can be added to raw crude oil before refining or at any feedpoint in the refinery stream. The removal of sulfur prior to refining saves money by eliminating the need to remove sulfur during the refinery process. Since the process involves the chemical removal of sulfur, the cost of expensive equipment can be avoided. This is particularly advantageous to the smaller refinery operations.

DEFINITIONS AND ABBREVIATIONS

Figure 1:
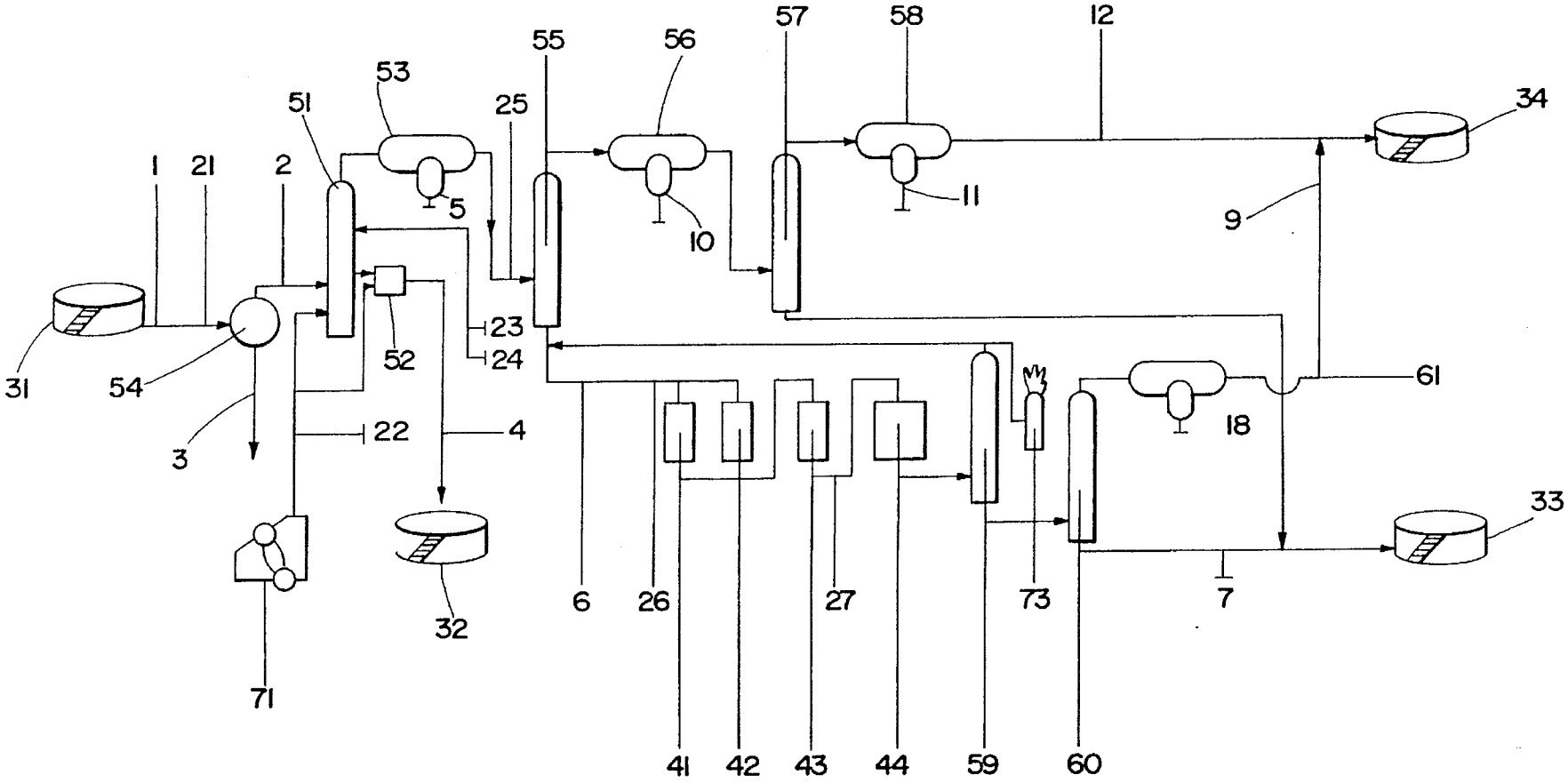
FIG. 1 is a schematic diagram of a simple refinery.

CRUDE OIL—for purposes of this patent application, "crude oil" shall mean any unrefined or partially refined oil which contains sulfur in any significant amount, possibly in the presence of other contaminants, particularly heavy and light crudes which are refined to make petroleum products.

DREWCOR—a registered trademark of Ashland Oil, Inc. DREWCOR 2130 is chemically defined as a blend of amines and MEKOR such that the amount of MEKOR is about 5% by weight.

FEED POINT—place where reducing agent is injected into the sulfur containing hydrocarbon.

LSCO—Louisiana sweet crude oil.

MEKOR—MEKOR is a registered trademark of Ashland Oil, Inc. and is chemically defined as methyl ethyl ketoxime [$H_3C(C{=}NOH)CH_2CH_3$].

PETROLEUM PRODUCTS—products produced by refining crude oil including gasoline, diesel fuel, propane, jet fuel, kerosene, naphtha, benzene, gasoline, aniline, etc.

REFINERY PROCESS STREAM—any refinery stream associated with the processing or transport of hydrocarbons in a refinery, including emulsions, water streams, condensate streams, stripping steam, particularly refinery process streams carrying crude oil and other hydrocarbons such as petroleum products, most particularly refinery process streams which carry three phases of material, namely a liquid hydrocarbon phase, a gaseous hydrocarbon phase, and an aqueous phase. The refinery process streams treated either contain sulfur as a contaminant or empty into a refinery process stream which contains sulfur as a contaminant.

ppm—parts per million MEKOR.

PSR—percent sulfur reduction.

SAMPLE POINT—place where a sample of a treated crude oil or refinery process stream is taken to determine if there Was a reduction in sulfur.

SCBT—sulfur content before treatment.

SCAT—sulfur content after treatment.

DETAILED DESCRIPTION OF DRAWING

FIG. 1 illustrates the flow chart of a simple refinery. It shows the sample points 1–12 for the refiner process streams tested, feedpoints for MEKOR 21–27, storage tanks 31–34, reformers 41–44, vessels 51–61, boiler 71, and hydrogen flare 72. Raw untreated crude oil 31 is fed to the desalter 54 where it is desalted and pumped into the crude tower 51. From the crude tower, a crude gasoline fraction is pumped into the raw gas accumulator 53 and then to the splitter tower 55. Fractions of the separated gasoline are pumped from the splitter tower to the depropanizer 57, the reformer 41–44, and to the hydrogen separator 59. The fraction from the hydrotreater is pumped to the stabilizer tower 60. MEKOR is fed into the process at feedpoints 21–27. Sample points include 1–12. The specific components in FIG. 1 are identified as follows:

SAMPLE POINTS

1 RAW CRUDE
2 CRUDE OUT OF DESALTER
3 WATER OUT OF DESALTER
4 DIESEL TO STORAGE TANK
5 WATER OUT OF RAW GAS ACCUMULATOR
6 SPLITTER BOTTOMS
7 STABILIZER BOTTOMS
8 WATER OUT OF STABILIZER ACCUMULATOR
9 STABILIZER PROPANE
10 WATER OUT OF SPLITTER ACCUMULATOR
11 WATER OUT OF DEPROPANIZER ACCUMULATOR
12 DEPROPANIZER PROPANE

CHEMICAL FEED POINTS

21 MEKOR INTO RAW CRUDE
22 MEKOR INTO STRIPPING STEAM TO CRUDE TOWER
23 MEKOR INTO CRUDE TOWER REFLUX
24 DREWCOR 2130 INTO CRUDE TOWER REFLUX
25 MEKOR INTO SPLITTER TOWER FEED
26 1,1,1 TRICHLOROETHANE INTO REFORMATE FEED
27 MEKOR INTO REFORMERS

STORAGE TANKS

31 RAW CRUDE
32 DIESEL
33 GASOLINE
34 PROPANE

REFORMERS

41 REFORMER #1
42 REFORMER #2
43 REFORMER #3
44 REFORMER #4

VESSELS

51 CRUDE TOWER
52 DIESEL DRIER
53 RAW GAS ACCUMULATOR
54 DESALTER
55 SPLITTER TOWER
56 SPLITTER ACCUMULATOR
57 DEPROPANIZER TOWER
58 DEPROPANIZER ACCUMULATOR
59 HYDROGEN SEPARATOR
60 STABILIZER TOWER
61 STABILIZER ACCUMULATOR

OTHER

71 BOILER
72 HYDROGEN FLARE

DETAILED DESCRIPTION OF THE INVENTION

The reducing agents used in this process are selected from the group consisting of hydrazine, oximes, hydroxylamines (such as N,N-diethylhydroxylamine) erythorbic acid, and mixtures thereof. These reducing agents are described in U.S. Pat. Nos. 5,213,678 and 4,350,606 which are hereby incorporated by reference. Preferably used as reducing agents are oximes such as the ones described in U.S. Pat. No. 5,213,678 as having the formula:

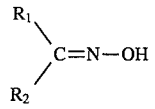

wherein $R_1$ and $R_2$ are the same or different and are selected from hydrogen, lower alkyl groups of 1–8 carbon atoms and aryl groups, and mixtures thereof. Most preferably used as the oxime are aliphatic oximes, particularly methyl ethyl ketoxime.

The reducing agent, crude oil, and/or refinery process stream to be desulfurized must be heated to a temperature of at least 50° C. in order to activate the reducing agent, preferably from 80° C. to 150° C. in order for the process to work effectively. The reducing agent can be added directly to a refinery process stream containing sulfur contamination, particularly a hydrocarbon process stream, or to an uncontaminated refinery process stream which flows into a contaminated refinery process stream contaminated with sulfur.

The amount of reducing agent needed in the process is an amount effective to reduce the sulfur content of the refinery process stream or the crude oil treated. Generally this amount is from 1 ppm to 100 ppm of reducing agent based upon the weight of the crude oil or the volume of the refinery stream to be treated, preferably 5 ppm to 70 ppm, and most preferably 10 ppm to 50 ppm.

The following detailed operating examples illustrate the practice of the invention in its most preferred form, thereby permitting a person of ordinary skill in the art to practice the invention. The principles of this invention, its operating parameters and other obvious modifications thereof will be understood in view of the following detailed procedure.

The crude oil and refinery process streams tested in the examples were from a small refinery which refines approximately 10,000 barrels of crude oil per day. The diagram of the refinery is shown in FIG. 1. The sulfur content of the refinery process streams in the Examples is expressed as percent by weight based upon the total weight of the process stream treated. Sulfur analysis for the treated and untreated crude oil and the various unrefined and refined petroleum fractions was determined by X-Ray florescence using the Horiba SLFA 1800/100 Sulfur-in-Oil Analyzer in accordance with ASTM standard test method D 4294-83.

EXAMPLES

Table I shows the test results for Louisiana sweet crude oil (LSCO). Table I compares the Control, LSCO which does not have MEKOR added, to LSCO after MEKOR was added. Note that there was some reduction of sulfur in the Control even though no MEKOR was added because some sulfur is removed during the refinery process as the crude oil moves from the feed point to the sample point. In the Examples of Table I, the MEKOR was heated to a temperature of about 50° C. to about 120° C. and injected directly into the crude oil 1 at feedpoint 21. The samples tested were collected at sample points 1–3. The examples in Table I illustrate that MEKOR reduces the sulfur content of LSCO.

TABLE I

EFFECT OF MEKOR ON SULFUR IN CRUDE OIL

| TEST | ppm | SCBT | SCAT | PSR |
|---|---|---|---|---|
| Control | 0.0 | 662 | 654 | 1.2 |
| 1 | 5.6 | 590 | 489 | 17.1 |
| 2 | 5.6 | 551 | 490 | 11.1 |
| 3 | 4.7 | 681 | 600 | 11.9 |

TABLE I-continued

| EFFECT OF MEKOR ON SULFUR IN CRUDE OIL | | | | |
|---|---|---|---|---|
| TEST | ppm | SCBT | SCAT | PSR |
| 4 | 4.7 | 735 | 619 | 15.8 |
| 5 | 11.9 | 579 | 463 | 20.0 |

Table I shows that the sulfur content of the LSCO was reduced by about 10 to about 20 weight percent by the addition of the MEKOR.

The results of treating diesel fuel with MEKOR are shown in Tables II (Control), III, IV, V, and VI. Note that there was some sulfur reduction in the Control even though no MEKOR was added. The reason for this is because some sulfur is removed during the refinery process as the raw crude is processed into diesel oil even if no MEKOR is added.

In the examples of Tables II-VI, MEKOR was heated to a temperature of 93° C. unless otherwise indicated before adding it to the feedpoint. In the examples of Table II, III, and IV, MEKOR was injected directly at feedpoint 22 into the stripping steam entering crude tower 51. In the examples of Table V, 4.75 ppm of MEKOR was injected into the raw crude 1 (93° C.) and 4.75 ppm MEKOR was injected into the stripping steam 22 of the crude tower 51. In the examples of Table VI, 11.9 ppm of MEKOR was injected into the raw crude (93° C.) 1 and 4.8 ppm MEKOR was injected into the stripping steam 22 of the crude tower 51.

The samples of diesel oil tested were collected at sample point 4.

TABLE II

| (CONTROL/UNTREATED DIESEL OIL) | | | | |
|---|---|---|---|---|
| TEST | ppm | SCBT | SCAT | PSR |
| 1 | 0 | 490 | 453 | 7.6 |
| 2 | 0 | 490 | 417 | 14.9 |
| 3 | 0 | 505 | 450 | 10.9 |
| 4 | 0 | 465 | 444 | 4.5 |
| Avg. | 0 | 390.0 | 352.8 | 7.6 |

TABLE III

| (TREATED DIESEL OIL) (MEKOR Feed Point: Stripping steam entering crude tower.) | | | | |
|---|---|---|---|---|
| TEST | ppm | SCBT | SCAT | PSR |
| 1 | 7.9 | 610 | 462 | 24.3 |
| 2 | 7.9 | 557 | 400 | 28.2 |
| 3 | 7.9 | 489 | 385 | 21.3 |
| 4 | 7.9 | 472 | 353 | 25.2 |
| Avg. | 7.9 | 532.0 | 400.0 | 24.8 |

TABLE IV

| (TREATED DIESEL OIL) (MEKOR Feed Point: Stripping steam entering crude tower.) | | | | |
|---|---|---|---|---|
| TEST | ppm | SCBT | SCAT | PSR |
| 1 | 19.8 | 613 | 388 | 36.7 |
| 2 | 19.8 | 638 | 415 | 35.0 |
| 3 | 19.8 | 566 | 415 | 26.7 |
| 4 | 19.8 | 565 | 399 | 29.4 |
| Avg. | 19.8 | 595.5 | 404.3 | 32.0 |

TABLE V

| (TREATED DIESEL OIL) (MEKOR Feed Points: 4.75 ppm Raw Crude (93° C.), 4.75 ppm Stripping Steam) | | | | |
|---|---|---|---|---|
| TEST | ppm | SCBT | SCAT | PSR |
| 1 | 9.5 | 681 | 422 | 38.0 |
| 2 | 9.5 | 735 | 442 | 39.9 |
| 3 | 9.5 | 675 | 439 | 35.0 |
| 4 | 9.5 | 807 | 398 | 50.7 |
| Avg. | 9.5 | 724.5 | 425.3 | 40.9 |

TABLE VI

| (TREATED DIESEL OIL) (MEKOR Feed Points: 11.9 ppm Raw Crude (25° C.), 4.8 ppm Stripping Steam) | | | | |
|---|---|---|---|---|
| TEST | ppm | SCBT | SCAT | PSR |
| 1 | 16.7 | 471 | 424 | 10.0 |
| 2 | 16.7 | 503 | 435 | 13.5 |
| 3 | 16.7 | 510 | 415 | 18.6 |
| 4 | 16.7 | 477 | 383 | 19.7 |
| Avg. | 16.7 | 490.3 | 414.3 | 15.5 |

Tables II to VI show that the addition of MEKOR to the crude oil and/or stripping steam of the crude tower effectively reduces the amount of sulfur in the diesel oil produced by the refinery.

The Examples of Tables VII and VIII illustrate the use of DREWCOR 2130 corrosion inhibitor and MEKOR in reducing sulfur in depropanizer propane and stabilizer propane. In the examples of Tables VII and VIII, MEKOR was not preheated, but was added at feedpoints 23–25.

The samples of depropanizer propane were collected at sample point 12 and the samples of stabilizer propane were collected at sample point 9.

TABLE VII

| (EFFECT OF MEKOR ON SULFUR - DEPROPANIZER PROPANE) (Test 1 used DREWCOR 2130 inhibitor. Test 2 used MEKOR) | | | |
|---|---|---|---|
| TEST | ppm | SCAT | PSR |
| Control | 0 | 200.0 | NA |
| 1 | 1 | 70.0 | 65 |
| 2 | 30 | 2.5 | 98.8 |

TABLE VIII

| (EFFECT OF MEKOR ON SULFUR - STABILIZER PROPANE) (Test 1 used DREWCOR 2130 inhibitor. Test 2 used MEKOR) | | | |
|---|---|---|---|
| TEST | ppm | SCAT | PSR |
| Control | 0 | 200.0 | NA |
| 1 | 1 | 6.5 | 96.5 |
| 2 | 30 | 2.5 | 99.8 |

The test data in Tables VII and VIII indicate that both DREWCOR 2130 corrosion inhibitor and MEKOR are effective at reducing the sulfur content in depropanizer propane and stabilizer propane.

The data in Tables I to VIII show that MEKOR, at various concentrations, effectively reduces the sulfur content of the crude oil and petroleum products made from the crude oil.

Furthermore, this effect is shown when the MEKOR is introduced in different feedpoints of the refinery.

We claim:

1. A process for reducing the sulfur in a refinery process stream selected from the group consisting of an emulsion, water stream, condensate stream, stripping stream, hydrocarbon-containing stream and mixtures thereof comprising:

adding to said refinery process stream an effective sulfur reducing amount of a reducing agent selected from the group consisting of hydrazine, oximes, hydroxylamines, carbohydrazide, erythorbic acid, and mixtures thereof wherein said reducing agent, said refinery process stream, or both have a temperature of at least 50° C. to thereby reduce the level of sulfur in said refinery process stream.

2. The process of claim 2 wherein the amount of reducing agent is from 1 ppm to 100 ppm, said ppm being based upon the volume amount of refinery stream treated.

3. The process of claim 1 wherein the reducing agent is methyl ethyl ketoxime.

4. The process of claim 3 wherein the reducing agent or the refinery process stream treated has a temperature of from 80° C. to 150° C.

5. The process of claim 2 wherein the refinery process stream treated is a hydrocarbon stream and the amount of methyl ethyl ketoxime is from 10 ppm to 50 ppm based upon the volume amount of hydrocarbon in the refinery process stream treated.

6. The process of claim 5 wherein the methyl ethyl ketoxime is added to a refinery process stream by adding said methyl ethyl ketoxime to a chemical feed point selected from the group consisting of raw crude, the raw crude tower, stripping steam to crude tower, crude tower reflux, splitter tower feed, reformate feed, and reformer.

7. A process for reducing the sulfur in crude oil comprising:

adding to said refinery process stream an effective sulfur reducing amount of a reducing agent selected from the group consisting of hydrazine, oximes, hydroxylamines, carbohydrazide, erythorbic acid, and mixtures thereof wherein said reducing agent, said refinery process stream, or both have a temperature of at least 50° C. to thereby reduce the level of sulfur in said crude oil treated.

8. The process of claim 7 wherein the amount of reducing agent is from 1 ppm to 100 ppm based upon the weight of the crude to be treated.

9. The process of claim 8 wherein the reducing agent is methyl ethyl ketoxime.

10. The process of claim 9 wherein the reducing agent or the crude oil treated has a temperature of from 80° C. to 150° C.

11. The process of claim 10 wherein the amount of methyl ethyl ketoxime is from 10 ppm to 50 ppm based upon the weight of the crude oil to be treated.

12. The process of claim 1 wherein said refinery process stream contains a liquid hydrocarbon phase, a gaseous hydrocarbon phase and an aqueous phase.

13. The process of claim 1 wherein the amount of reducing agent is from 5 ppm to 70 ppm based upon the volume amount of the refinery stream.

14. The process of claim 1 wherein the amount of reducing agent is from 5 ppm to 70 ppm based upon the weight of the crude to be treated.

* * * * *